US005771603A

United States Patent [19]

Kotitschke et al.

[11] Patent Number: 5,771,603

[45] Date of Patent: Jun. 30, 1998

[54] DRYER SECTION

[75] Inventors: Gerard Kotitschke, Steinheim; Hans-Peter Sollinger, Heidenheim; Markus Oechsle, Bartholomae; Karlheinz Straub, Heidenheim, all of Germany

[73] Assignee: Voith Sulzer Papiermashinen GmbH, Germany

[21] Appl. No.: 719,390

[22] Filed: Sep. 24, 1996

Related U.S. Application Data

[63] Continuation-in-part of Ser. No. 344,736, Nov. 23, 1994, Pat. No. 5,557,860.

[30] Foreign Application Priority Data

Sep. 16, 1994 [DE] Germany ..... 94 14963.1

[51] Int. Cl.[6] ..... D21F 5/00

[52] U.S. Cl. ..... 34/446; 34/117; 34/119

[58] Field of Search ..... 34/117, 118, 119, 34/120, 124, 125, 128, 306, 414, 445, 446, 451, 60, 61, 62; 162/275, 289

[56] References Cited

U.S. PATENT DOCUMENTS 3,948,721 4/1976 Winheim ..... 162/207
4,986,009 1/1991 Haessner et al. ..... 34/458
5,269,074 12/1993 Sims et al. ..... 34/117
5,311,672 5/1994 Kotitschke et al. ..... 34/117

FOREIGN PATENT DOCUMENTS 4328554 3/1994 Germany .

*Primary Examiner*—Henry A. Bennett
*Assistant Examiner*—Stephen Gravini
*Attorney, Agent, or Firm*—Ostrolenk, Faber, Gerb & Soffen, LLP

[57] ABSTRACT

A drying section for a paper making machine. The drying section includes a plurality of single-tier dryer groups, optionally followed by one or more double-tier groups. To control curl in the final paper product, a moistening device extending over the width of the drying section is provided near the end of the single-tier dryer groups. The moistening device can be divided into various zones to control the profile of the paper. Alternatively, or in addition to the moistening device, a contact-less dryer such as a infrared dryer can be provided after the dryer section, upstream of a calendar section of the paper making machine. The moistening device can be provided to moisten the bottom or, optionally, the top side of the paper web. Where a double-tier dryer group is provided, to control curl the upper drying cylinders and the lower cylinders can be provided with different steam pressures to control curl. Alternatively, each of the cylinders can be individually controlled.

35 Claims, 8 Drawing Sheets

41
40
30
9
S
17
VIII
51
31
16
51B
51A 51
31

31b
31a
51

DRYER SECTION

RELATED APPLICATION

This is a continuation-in-part of application Ser. No. 08/344,736 filed Nov. 23, 1994, now U.S. Pat. No. 5,557, 860.

BACKGROUND OF THE INVENTION

The present invention relates to a drying section for drying a traveling fiber web, particularly a paper web. The drying section is preferably part of a paper manufacturing machine. Various drying sections of this type are known, for example, from U.S. Pat. No. 5,311,672 and from Federal Republic of Germany Patent Publication No. 43 28 554 A1.

From these publications it is known to divide a drying section into several successive drying groups. Any one of the drying groups can be developed either as a single-felt drying group or as a two-felt drying group. In one known variant, all drying groups are developed as single-felt drying groups, for instance in the manner that all cylinders have the felt on their top so that the bottom side of the web always comes into contact with the cylinders.

The foregoing arrangement affords the following advantages: The web to be dried is supported and guided continuously by a support belt ("drying wire" or "felt"), at least within each individual drying group. Unsupported lengths of web are thus avoided so that even with extremely high paper web speeds (on the order of up to 2000 meters/min), fluttering of the web is avoided and the danger of the web tearing is considerably reduced. At the transfer zones between adjacent drying groups, there is the option of either avoiding an unsupported (open draw) section of web or of providing a short unsupported length of web. If, in rare cases, the web should nevertheless tear, the torn web pieces (broke) can be easily removed by the force of gravity, due to the fact that all cylinders are top felted.

For the manufacture of certain types of paper it is disadvantageous to dry the paper web solely from one side. The two sides of the finished web may have slightly different characteristics. This results in a tendency to curl, i.e. the edges of the finished web or the edges of sheets of paper (produced from the web) do not lie flat, but bend downward or upward. The paper generally curls towards the side which was dried indirectly, i.e. the side which was in contact with the felt rather then the dryers.

So-called mixed or composite drying sections are also known in which at least one two-felted drying group is provided downstream of several single-felted drying groups. The final drying of the paper web generally takes place in the two-felt drying group, the two sides of the web alternately contacting the drying cylinders. With this arrangement, for numerous types of paper, the tendency to curl is substantially reduced or even completely eliminated. From several United States patents it is known, in the case of such a two-felt drying group serving for the final drying, to control the supply of thermal energy to an upper row of cylinders independently of the supply of thermal steam energy to the lower cylinders. In this way, the tendency of the final paper to curl is also prevented or reduced.

The known measures described above may be sufficient for the manufacture of numerous types of paper. In many cases, however, it is desired to counteract the tendency of the final paper to curl with even greater certainty.

SUMMARY OF THE INVENTION

It is an object of the present invention to meet the aforementioned objectives.

Another object of the invention is to provide a drying section which intentionally imparts to the final web a certain tendency to curl towards a given side. This may be necessary when the two sides of the paper are moistened to a different extent during printing on the final paper product, i.e. during the final use of the paper.

The following considerations and discoveries have led to the present invention: In a dryer section having single-felt drying groups (particularly if all single-felt drying groups have the felt on top), the side of the paper coming into contact with the cylinders is heated more vigorously and therefore dries more rapidly. Therefore, this side of the paper (generally the bottom side of the web) also tends to shrink sooner than the opposite side (as a rule the top side of the web). As a result, a compressive stress is produced in the side of the paper which is dried later in time while a tensile stress develops in the side of the paper which has already dried more strongly. This effect becomes stronger and stronger during the course of the drying process until the one side (as a rule the bottom side of the web) is completely dry. At times, a tendency to curl resulting from this effect can be noted already in this state.

However, toward the end of the drying process, generally the side of the web which was initially dried with delay becomes also completely dry. It can then be noted, in many cases, that the tensile and compressive stresses on the two sides of the paper are reversed so that now there is a tendency of. the finished paper to curl in the other direction.

One important idea of the invention is that the side of the paper which dries faster and earlier is intentionally wetted during the drying process. In this way, it is possible to prevent the development of different, opposing tensile and compressive stresses on the two sides of the paper.

In accordance with a first aspect of the invention, a moistening device which is able to supply moisture to the web is provided in a region at the end zone of the drying section. This device can be a water spray device, a steam blow box or similar device. The moistening device may extend over the entire width of the web or over a portion of the web e.g. the edges. It can be subdivided over the width of the web into individually controllable zones, each of which can serve different purposes.

For example, the device serves to correct the transverse profile of the dry solid content of the web and/or to correct a varying or different tendency to curl over the width of the machine. It can happen that there is a greater tendency to curl at the edges of the web than in the middle of the paper web. This results from a difference in the amount of transverse shrinkage. In this case, therefore, the edges of the web will be moistened more intensively than the center of the web. Then it may be sufficient to provide only small moistening devices at the edges of the web rather than one which extends over the entire width of the web.

In accordance with another aspect of the invention, at least one additional contact-less dryer, for instance an infrared dryer, is arranged behind, that is downstream of the single-felt drying groups.

The moistening device can be arranged at different places along the paper making machine. A preferred place is adjacent one of the guide rolls of a single-felt drying groups, e.g. located within the last third of the drying section, as viewed alongside the entire drying section. Another possible location is between the end of the drying section and a following calendar. In this case, it is advantageous for at least one of the calendar rolls to be a heatable roll. Still another possible location is the space between two successive calenders. Several moistening devices which are preferably distributed over the above-mentioned places can also be provided. Preferably, one or more contact-less dryers will also be arranged between the drying section and the following calendar and/or between two calenders.

In all of the aforementioned embodiments of the invention, the drying section can be constructed to consists only of single-felted drying groups. As an alternative, one or more double-felt drying groups can also be provided in the end region of the drying section.

In accordance with a third aspect of the invention, in order to reduce the tendency of the final web to curl, at least one double-felt drying group is provided in the end region of the drying section, in which group the drying rate of at least one of the upper cylinders can be adjusted independently of the drying rate of at least one of the lower cylinders. There are many possibilities for achieving this purpose:

a) Particularly in the initial region of the double-felt dryer group (or of the two-felt drying groups), the feeding of steam energy to at least one of the upper cylinders can be controlled independently of the feeding of steam energy to at least one lower cylinder. Thus, the top side of the web can be brought into contact with more strongly heated cylinders than the bottom side of the web. This measure is particularly effective in the case of many types of paper especially at the beginning of the two-felt (double-felt) drying group or groups in order to reduce the tendency of the finished paper to curl.

b) In drying particularly sensitive types of paper it is, however, advantageous to supply heat energy to each of the cylinders of the two-felt drying group or groups in an individually controllable manner. In this way, the supply of heat energy can be increased or reduced from cylinder to cylinder depending on the individual requirements of the final paper product.

c) Another solution involves establishing different felt tensions on the top and bottom cylinders in the two-felt drying group (or two-felt drying groups). The longitudinal tension in at least one lower felt is preferably set at a higher value, so that the surface pressure between paper web and cylinder surface is increased on the lower cylinders in order to thereby increase the transfer of heat from the lower cylinders to the top side of the web.

d) A further solution involves increasing the drying rate of the lower cylinders of the two-felt drying group by installing, in known manner, condensate disturbance ledges in at least one of the lower cylinders. The construction and action of such disturbing ledges is described in U.S. Pat. No. 4,282,656, the contents of which are incorporated by reference herein.

All the embodiments of the invention which have been described can furthermore also have the feature that most of or all of the guide suction rolls in the singlefelt drying group are free of internal stationary suction boxes. In this connection, the vacuum necessary within the perforated suction rolls is preferably produced by means of an external stationary suction box in each case. This measure is preferably combined with a relatively large diameter suction rolls and/or with relatively large spacings between the suction roll and the two adjacent cylinders. In this way, there is obtained a relatively long evaporation path comprising a joint run of the paper web and the felt between the two cylinders (in order to increase the drying rate). Also the arrangement provides a sufficient space and a sufficiently long travel path of the web for the arrangement or effectiveness of the aforementioned moistening device.

Other features and advantages of the present invention will become apparent from the following description of the invention which refers to the accompanying drawings.

BRIEF DESCRIPTION OF THE DRAWINGS

Various embodiments of the invention are shown in the accompanying drawings.

DETAILED DESCRIPTION OF THE INVENTION

Figure 1:
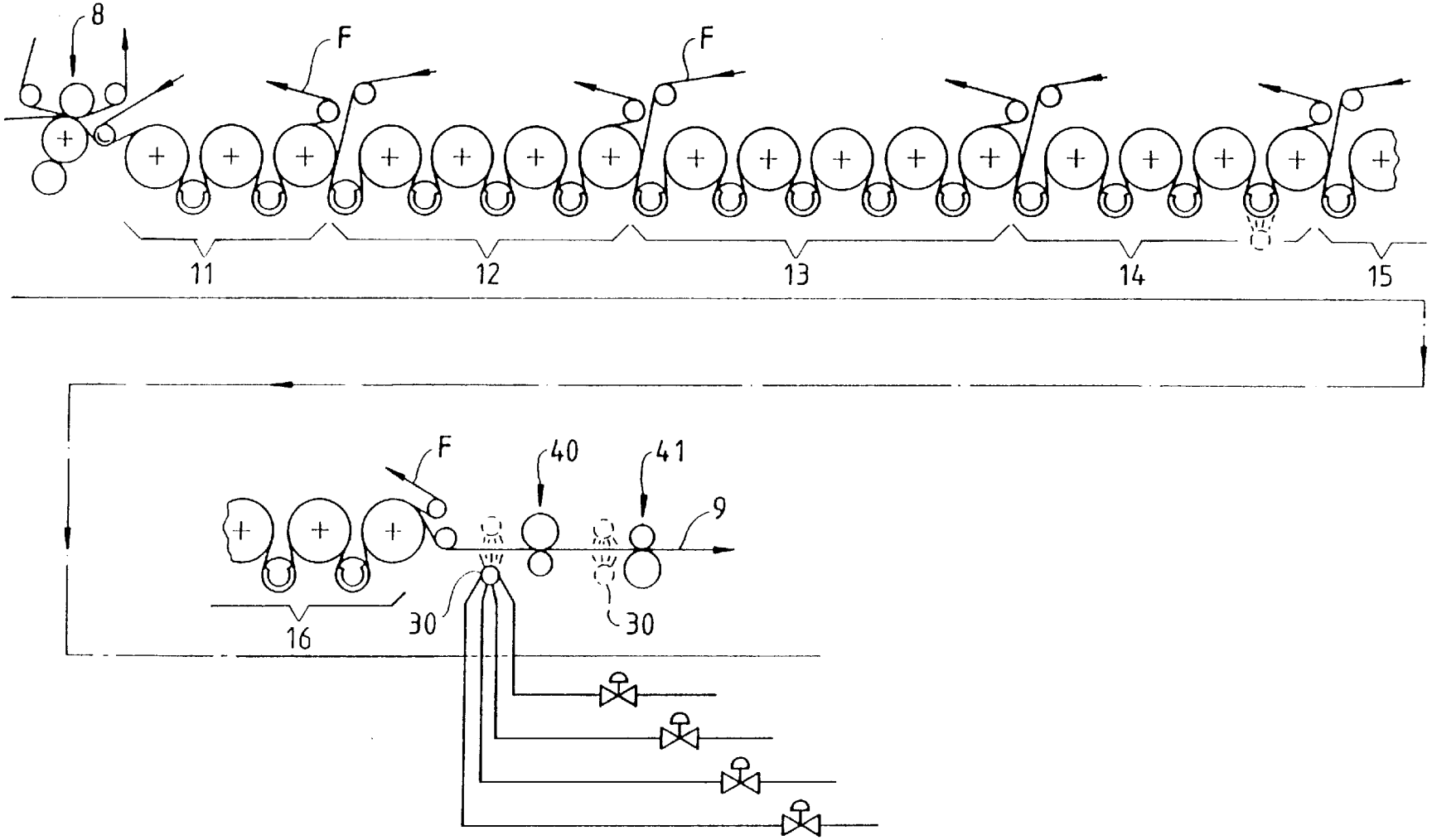
FIG. 1 is a diagrammatic side view of a first embodiment of a drying section of a paper making machine, showing a moistening device.
Figure 2:
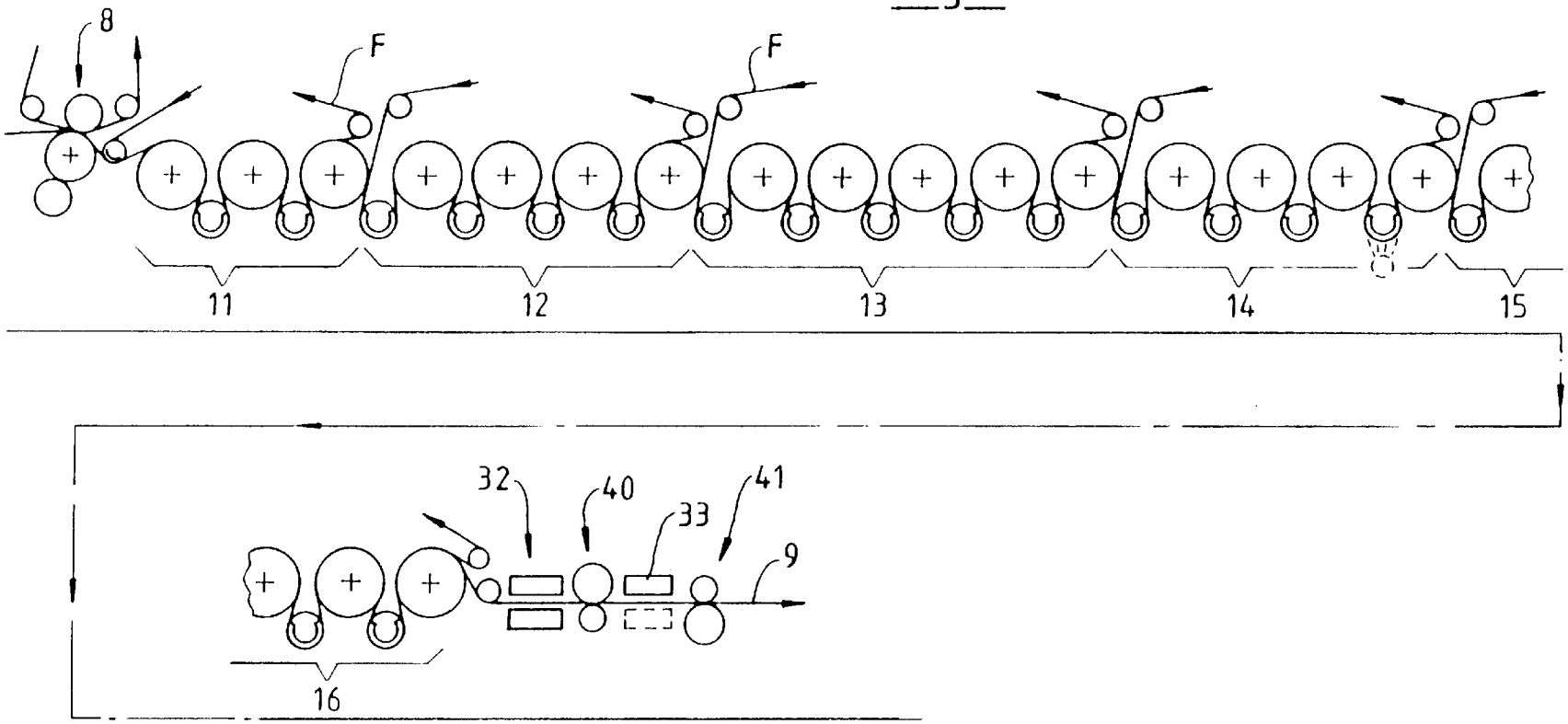
FIG. 2 is a diagrammatic side view of a drying section of a paper making machine, using infrared devices.

FIGS. 1 and 2 show a drying section consisting exclusively of single-felt drying groups (11–16) with felts F wrapping the tops of the drying cylinders. Also shown is a wet press (8) arranged upstream of the drying section and two calenders (40, 41) arranged downstream of the drying section. In accordance with FIG. 1, moistening devices (30) are provided and in accordance with FIG. 2 additional contact-less dryers, for instance infrared dryers (32, 33), are provided.

The moistening device 30 can have a water feed which can be controlled zone-wise, along the width of the paper web. Furthermore, depending on the production conditions of the paper, moistening devices can also be used for moistening the top side of the paper. This is true, in particular, when calenders (40, 41) are used, where, depending on the direction of tendency to curl, the wetting can be effected either on the top side, in front of the first nip or on the bottom side in front of the second nip, or vice versa.

FIGS. 3 to 7 show mixed drying sections, in which at least one two-felted drying group follows several single-felted drying groups which are top felted.

Figure 3:
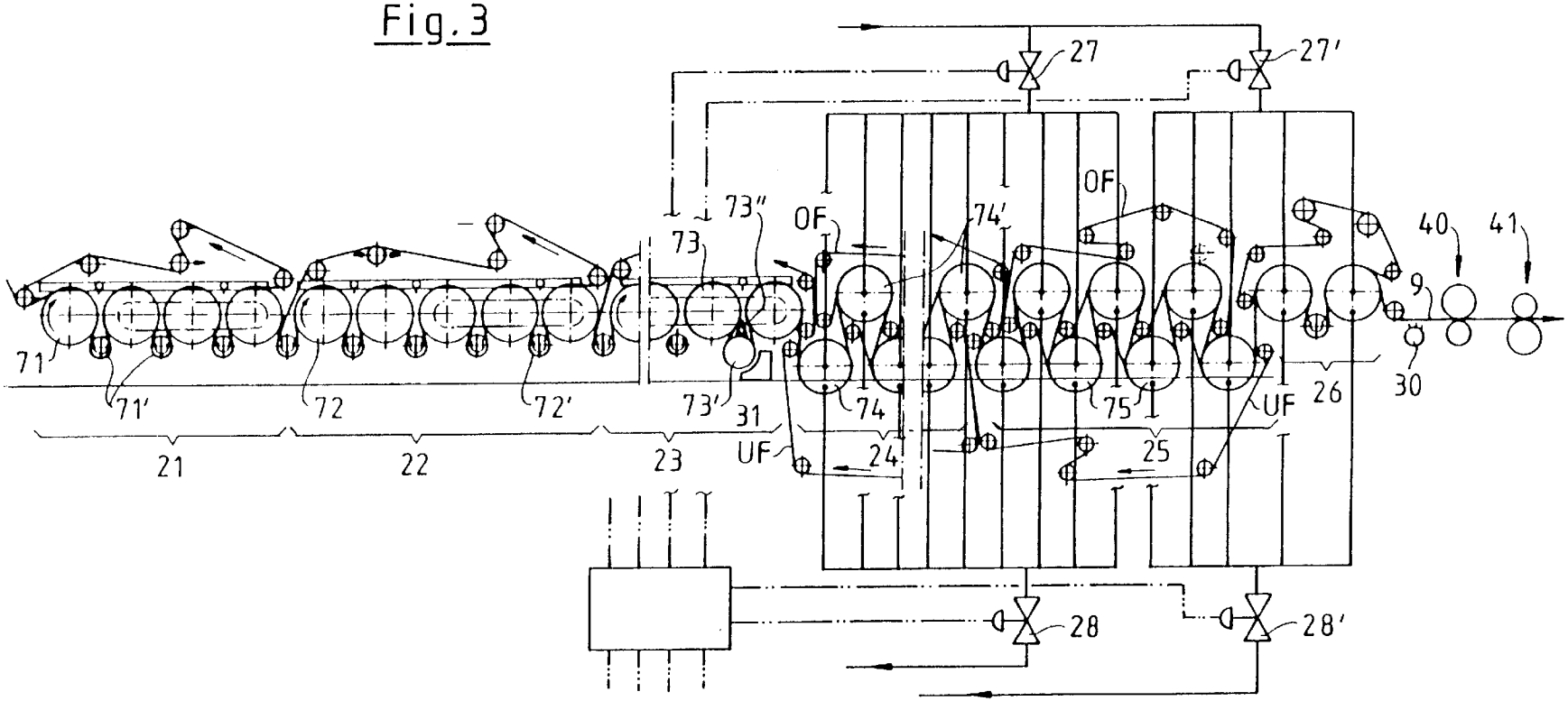
FIG. 3 is a diagrammatic side view of the end portion of a drying section of a paper making machine in accordance with the further embodiment of the present invention.

FIG. 3 shows a moistening device (for instance steam blow boxes 31) which are arranged a short distance in front of the transfer from the last single-felt drying group (23) to the following two-felt drying group (24). A further single-felt drying group (26) follows the second two-felt drying group (25). Similar to FIG. 1, a further moistening device 30 may be added between the drying section 21–26 and calenders 40, 41.

In accordance with FIG. 3, the supplying of steam to the upper and lower drying cylinders in the two-felt felt drying groups is commonly controlled, i.e. by means of a single valve (27, 27') for each heating group (and in the same manner the discharge of the condensate-steam mixture from the cylinders is commonly controlled by means of one common valve 28, 28' for each heating group).

Figure 4:
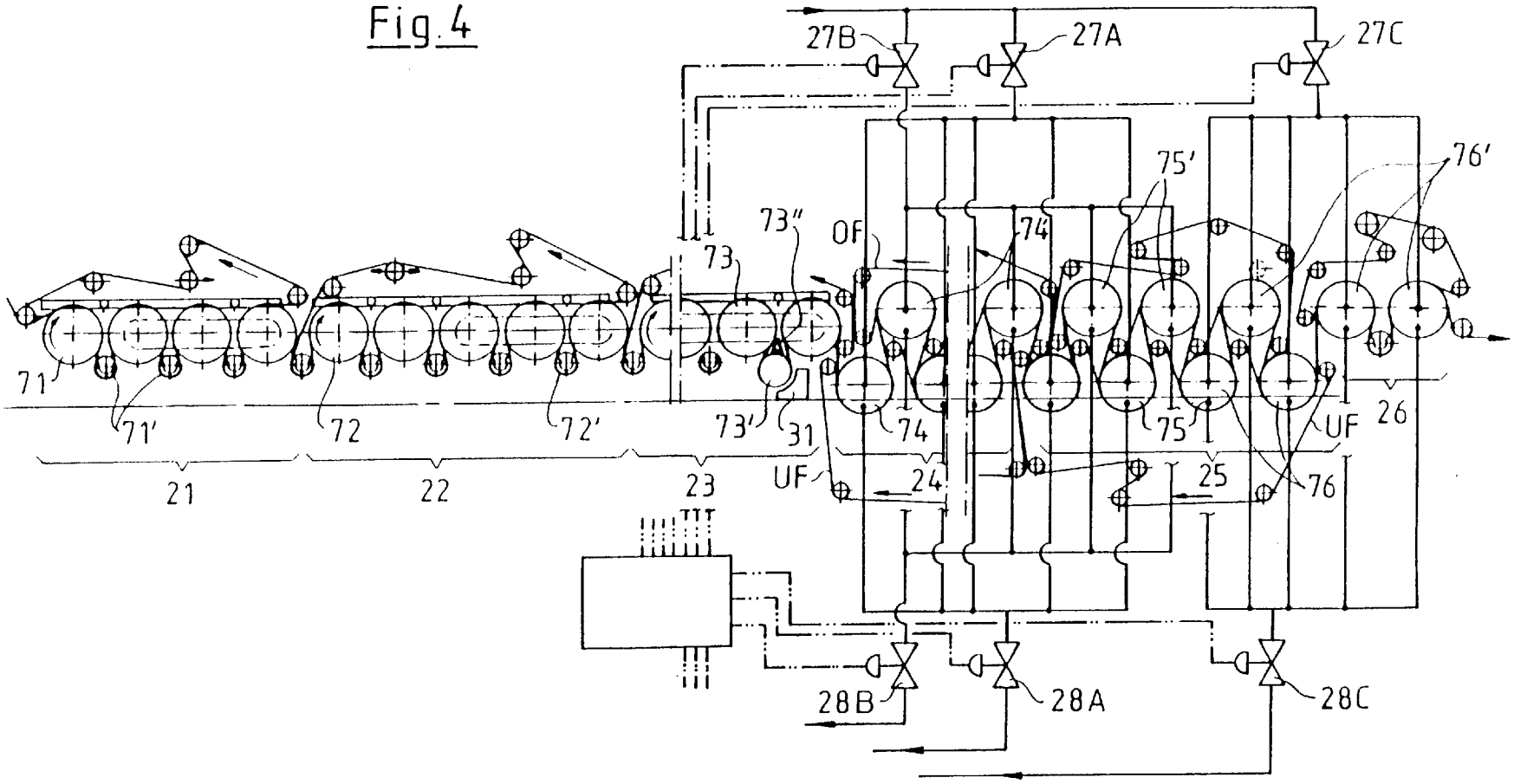
FIG. 4 is a diagrammatic side view of a still further embodiment of a drying section of a paper making machine in accordance with the present invention.

On the other hand, in FIG. 4 in a front upstream region of the two-felt drying groups (24, 25), the feeding of steam to the lower cylinders (74, 75) is controlled (by means of valves 27A and 28A) independently of the feeding of steam to the upper cylinders (74', 75') (by means of valves 27B and 28B). In the rear part of the drying section, on the other hand, steam is uniformly supplied to upper and lower drying cylinders (76'and 76) by means of valves 27C and 28C. In addition, a moistening device (31) can be (if necessary or desired) used.

Both in FIGS. 3 and 4 (see also FIG. 1) the moistening device is positioned to spray water or steam at the paper web, as the paper web traverses one of the transfer guide rolls which are located at the end region of the single tier portion of the paper making machine. An advantage of spraying water or steam at the paper web as it traverses a vacuum roll is that the high suction produced by the vacuum guide rolls serves to draw the moisture deeper into the paper web so that the object to counteract curl can be realized with a lesser amount of water due to the deeper penetration of the water into the paper web. This also affords the possibility of controlling curl by controlling the amount of vacuum supplied inside the vacuum guide roll about which the paper web is being moistened.

Figures 5, 8, 9:
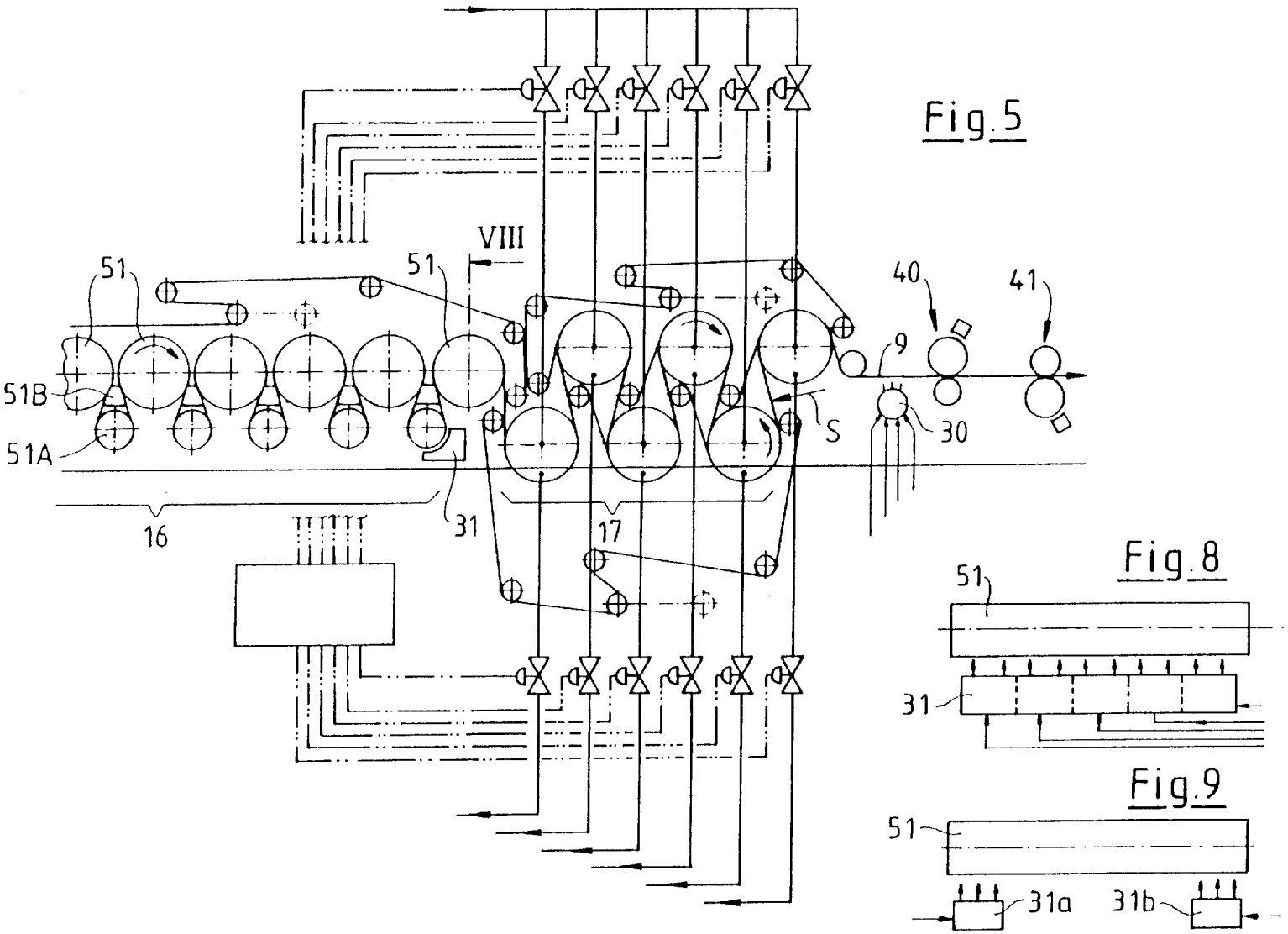
FIG. 5 is a diagrammatic view of yet another embodiment of a drying section in accordance with a further embodiment of the present invention, using a moistening device.
FIGS. 8 and 9 are cross sections along line VIII of FIG. 5.

In accordance with FIG. 5, all guide suction rolls (51A) in the last single-felt drying group (16) are provided with external stationary suction boxes (51B). Such suction rolls and corresponding boxes (for instance 73', 73", in FIGS. 3 and 4) can also be provided in all of the other figures, instead of the suction rolls with inner stationary suction boxes.

As shown in FIG. 5, the feeding of steam to each of the six individual cylinders can be controlled individually in the two-felt drying group (17). As an alternative (not shown), at least one pair of one bottom cylinder and one top cylinder may be added which may be commonly controlled as shown in FIG. 3. Moistening devices 30 and/or 31 may be provided as explained above.

FIG. 8 shows a machine-wide moistening device 31, which may be subdivided into individually controllable zones. FIG. 9 shows an alternative comprising only edge-moistening devices 31*a*, 31*b*.

Figure 6:
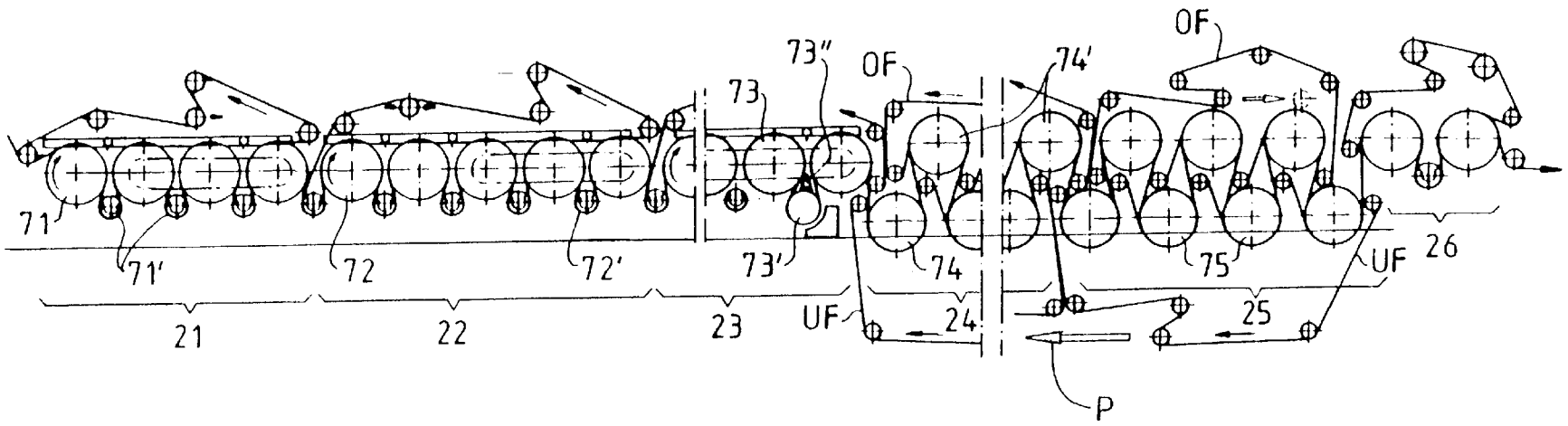
FIG. 6 is a diagrammatic side view of a portion of a drying section illustrating the use of gutless vacuum rolls which operate in conjunction with external vacuum boxes.

In accordance with FIG. 6, in a two-felt drying group 25 the lengthwise tension of the lower felt UF can be set at a substantially higher value (represented symbolically by the arrow P) than that of the upper felt OF.

Figure 7:
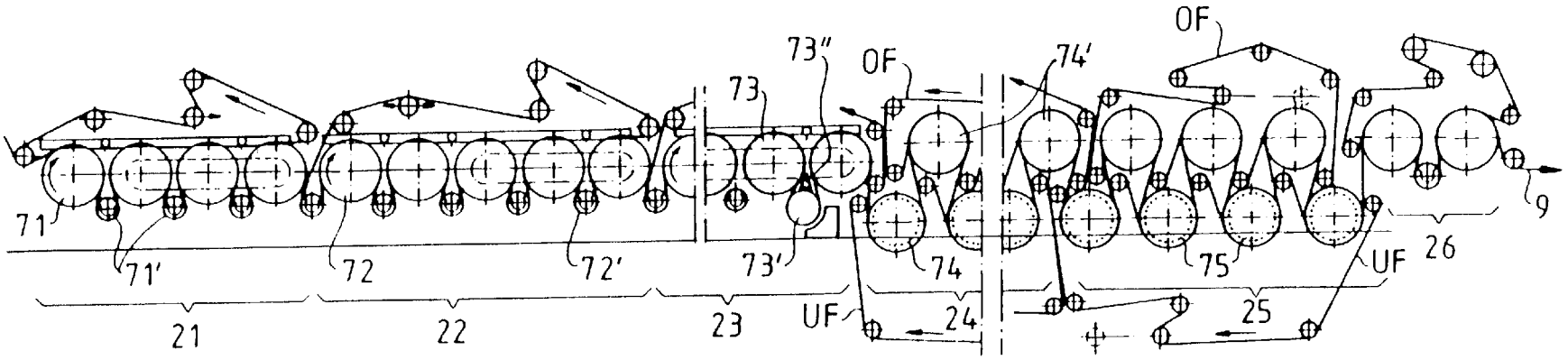
FIG. 7 is a diagrammatic side view of a further embodiment of a drying section of a paper making machine.

In accordance with FIG. 7, the lower cylinders 74 and 75 of the two-felt drying groups 24 and 25 are provided with condensate-disturbance ledges as represented symbolically by dotted circles.

In FIG. 4, the double-felted dryers are followed by a short single tier dryer group consisting of a pair of dryers 76' and a single vacuum roll.

Figure 10:
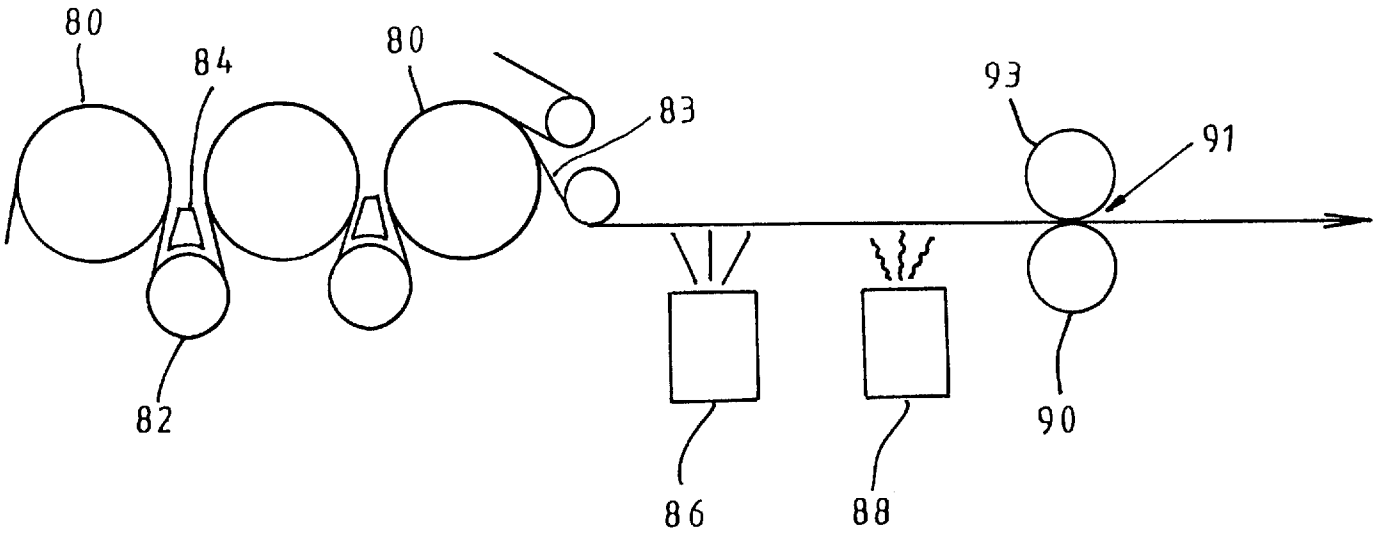
FIG. 10 is diagrammatic side view of a further feature of the present invention.

With reference to FIG. 10, a paper web traveling through a top-felted dry end tends to curl upward, a tendency that can be decreased or eliminated by moistening and then drying the bottom of the web.

The web is usually moistened with steam at the exit from the dry end. How much steam is employed depends on web temperature, area weight, output, dry content, and moisture absorbency (with respect to coating, sizing, dye, etc.), ranging between 15 and 250 and preferably between 30 and 100 kg/hr ●m.

Since it supports more condensation, a cooler web will absorb more moisture, and it is occasionally helpful to cool the side that is to be moistened (the bottom) to 40 to 80 and preferably to 50° to 70° C. before moistening it.

FIG. 10 illustrates the last few dryers 80 of a final top-felted dryer group which includes vacuum rolls 82 and suction boxes 84 which operate in well-known manner. The paper web 83 which emerges from the last dryer has its bottom side subjected to cooling air which is provided from a cooler 86. This increases the ability of the bottom side to absorb moisture from the moistening device 88. Thereby, the curl is controlled. Eventually the bottom of the web is dried in the downstream smoothsurfaced nip 91 which is defined between the cylinders 90 and 93. The lower cylinder 90 effects the drying inasmuch as it is heated in well-known manner. Alternatively, the bottom side of the paper web 83 can be dried by heating the bottom surface thereof with other means such as with infrared radiation, hot air, heated guide rolls, etc.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

a moistening device being arranged at an end region of the drying section for reducing the tendency of the final web to curl;

a cooling device preceding the moistening device for directing cooling air at a bottom surface of the paper web to promote greater absorption of moisture from the bottom surface of the paper web in response to the action of the moistening device; and in which the moistening device is located to moisten a bottom side of the paper web.

2. The drying section of claim 1, in which the moistening device extends substantially over the entire width of the web.

3. The drying section of claim 1, in which the moistening device is located adjacent an end zone of the single-felt drying group.

4. A drying section according to claim 1, in which the moistening device is divided over the width of the web into zones so that a moistening output of each zone is individually controllable.

5. A drying section according to claim 1, in which the moistening device is constituted as a water spraying device.

6. A drying section according to claim 1, in which the moistening device is constituted as a steam blow box.

7. A drying section according to claim 1, in which the single-felt drying groups are top felted and in which the moistening device includes means to optionally moisten a bottom side or a top side of the paper web.

8. A drying section according to claim 1, including at least one two-felt drying group located downstream of the single felt drying groups, the at least one two-felt drying group including upper cylinders and lower cylinders.

9. A drying section according to claim 1, including means for adjusting a drying output of at least one of the upper cylinders independently of a drying output of at least one of the lower cylinders.

10. A drying section according to claim 9, including means for controlling the supply of thermal energy to at last one of the upper cylinders independently of the supply of thermal energy to at least one of the lower cylinders.

11. A drying section according to claim 10, including means for individually controlling the supply of heat to each of the cylinders of at least a sub-group of the two-felt drying group.

12. A drying section according to claim 10, including means for controlling the longitudinal tension of at least one of a lower felt and an upper felt of the at least one two-felt drying group to provide different tensions in the lower felt and the upper felt.

13. A drying section according to claim 9, in which at least one of the lower cylinders of the at least one two-felt drying group is provided with condensate-disturbance ledges.

14. A drying section according to claim 10, in which at least most of the suction guide rolls are free of internal stationary suction boxes.

15. A drying section according to claim 1, in which an external stationary suction box is associated with each of the suction guide rolls that is free of an internal stationary suction box.

16. Method for drying a paper web in a paper making machine, the method including the steps of:

guiding the paper web over a plurality of heatable drying cylinders arranged as a plurality of successively located drying groups of a drying section;

moistening the paper web at least at the edges thereof or substantially over the entire width thereof at an end region of the drying section for reducing the tendency of the paper web to curl; and directing cooling air at a bottom side of the paper web prior to said moistening of the paper web, to cool the bottom side of the paper web to promote greater absorption of moisture through the bottom side of the paper web.

17. The method of claim 16, further including carrying out the moistening step with a moistening device which is divided over the width of the paper web into zones and individually controlling the amount of moisture outputted at each zone.

18. The method of claim 17, including configuring the drying section so that only the bottom side of the paper web contacts the heatable drying cylinders.

19. A drying section for the drying of a paper web in a paper making machine, comprising:

a plurality of heatable drying cylinders for contacting the paper web in each of a plurality of successively located drying groups;

at least in an initial region of the drying section comprising a substantial majority of the heatable drying cylinders of the entire drying section, the drying groups being configured as single-felt drying groups, in which a respective single endless felt and the paper web travel together alternately over the heatable cylinders and over vacuum guide rolls so that one side of the paper web contacts the heatable cylinders;

a moistening device being arranged at an end region of the drying section for reducing the tendency of the final web to curl; and a cooling device preceding the moistening device for cooling a bottom surface of the paper web to promote greater absorption of moisture from the bottom surface of the paper web in response to the action of the moistening device.

20. Method for drying a paper web in a paper making machine, the method including the steps of:

guiding the paper web over a plurality of heatable drying cylinders arranged as a plurality of successively located drying groups of a drying section;

moistening the paper web at least at the edges thereof or substantially over the entire width thereof at an end region of the drying section for reducing the tendency of the paper web to curl; and directing cooling air at a bottom side of the paper web prior to said moistening of the paper web, to cool the bottom side of the paper web to promote greater absorption of moisture through the bottom side of the paper web.

21. A drying section for the drying of a paper web in a paper making machine, comprising:

a plurality of heatable drying cylinders for contacting the paper web in each of a plurality of successively located drying groups;

at least in an initial region of the drying section, the drying groups being configured as single-felt drying groups, in which a respective single endless felt and the paper web travel together alternately over the heatable cylinders and over vacuum guide rolls so that one side of the paper web contacts the heatable cylinders;

a moistening device being arranged at an end region of the drying section for reducing the tendency of the final web to curl;

a cooling device preceding the moistening device for cooling a bottom surface of the paper web to promote greater absorption of moisture from the bottom surface of the paper web in response to the action of the moistening device; and a dryer located downstream of the moistening device and arranged to dry the bottom surface of the paper web.

22. The drying section of claim 21, in which the dryer located downstream of the moistening device is a smooth-surfaced nip defined between a pair of cylinders.

23. The drying section of claim 21, in which the pair of cylinders includes a heated lower cylinder.

24. The drying section of claim 22, in which the moistening device supplies a steam to the paper web at a rate of 15 to 250 kg/(hr-m).

25. The drying section of claim 24, in which the steam is supplied in a range of from 30 to 100 kg/(hr-m).

26. The drying section of claim 25, in which the cooling device includes means for cooling the paper web prior to the moistening thereof to a temperature between 40° to 80° C.

27. The drying section of claim 22, in which the paper web is cooled to a temperature in the range of from 15° to 70° C.

28. The method of claim 27, further including drying the paper web after the moistening thereof.

29. The method of claim 21, in which the bottom side of the paper web is dried in a smooth-surfaced nip.

30. The method of claim 22, including moistening the paper web with steam applied thereto at the rate of from 15 to 150 kg/(hr m).

31. The method of claim 21, in which the steam is applied in the range of from 30 to 100 kg/(hr/m).

32. The method of claim 31, including cooling the bottom side of the paper web to a temperature in the range of from 40° to 80° C. prior to the moistening thereof.

33. The method of claim 21, in which the bottom side of the paper web is cooled to a temperature in the range of from 50° to 70° C.

34. A drying section for the drying of a paper web in a paper making machine, comprising:

a plurality of heatable drying cylinders for contacting the paper web in each of a plurality of successively located drying groups;

at least in an initial region of the drying section comprising a substantial majority including at least two-thirds of all the heatable drying cylinders of the entire drying section, the drying groups being configured as single-felt drying groups, in which a respective single endless felt and the paper web travel together alternately over the heatable cylinders and over vacuum guide rolls so that one side of the paper web contacts the heatable cylinders;

a moistening device being arranged solely at an end region following said initial region of the drying section for reducing the tendency of the final web to curl; and a cooling device preceding the moistening device for cooling a bottom surface of the paper web to promote greater absorption of moisture from the bottom surface of the paper web in response to the action of the moistening device.

35. Method for drying a paper web in a paper making machine, the method including the steps of:

first guiding the paper web over a plurality of heatable drying cylinders arranged as a plurality of successively located drying groups of a drying section, the drying cylinders being located at an initial region of the drying section, the initial region including at least two-thirds of all heatable drying cylinders of said drying section;

guiding the paper web over a plurality of vacuum guide rolls interposed between the heatable drying cylinders;

guiding the paper web over drying cylinders located at an end region following said initial region of said drying section;

moistening the paper web solely at said end region for reducing the tendency of the paper web to curl; and directing cooling air at a bottom side of the paper web prior to said moistening of the paper web, to cool the bottom side of the paper web to promote greater absorption of moisture through the bottom side of the paper web.

* * * * *